US006217305B1

(12) United States Patent
Schofield et al.

(10) Patent No.: US 6,217,305 B1
(45) Date of Patent: Apr. 17, 2001

(54) SCREW PUMPS

(75) Inventors: Nigel Paul Schofield, Horsham West Sussex; Michael Henry North, Reigate Surrey, both of (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/334,323

(22) Filed: Jun. 16, 1999

(30) Foreign Application Priority Data

Jun. 17, 1998 (GB) ..... 9813048
Jul. 7, 1998 (GB) ..... 9814659

(51) Int. Cl.[7] ..... F03C 2/00
(52) U.S. Cl. ..... 418/194; 418/201.1; 418/206.7
(58) Field of Search ..... 418/201.1, 206.7, 418/194

(56) References Cited

U.S. PATENT DOCUMENTS 1,191,423 * 7/1916 Holdaway ..... 418/201.1
2,079,083 * 5/1937 Montelius ..... 418/201.1
2,511,878 * 6/1950 Rathman ..... 418/201.1
3,116,871 * 1/1964 Mishina et al. ..... 418/194
4,078,653 * 3/1978 Suter ..... 418/201.1
4,952,125 * 8/1990 Nagai ..... 418/194

FOREIGN PATENT DOCUMENTS 195 22 555 1/1997 (DE) .
1309885 * 9/1961 (FR) ..... 418/194
384355 * 12/1932 (GB) ..... 418/194
167597 * 1/1965 (SU) ..... 418/194

* cited by examiner

*Primary Examiner*—Thomas Denion
*Assistant Examiner*—Theresa Trieu
(74) *Attorney, Agent, or Firm*—Salvatore P. Pace

(57) ABSTRACT

A screw pump provided with a first shaft and spaced therefrom and parallel thereto a second shaft mounted in a pump body. A first rotor is mounted on the first shaft and a second rotor mounted on the second shaft. Each of the first and second rotors having formed on an outer surface thereof one or more one helical vanes or threads intermeshing together so that rotary movement of the shafts will cause a fluid to be pumped. A first bearing arrangement is associated with the first shaft and a second bearing arrangement is associated with the second shaft. A bearing carrier is provided for each bearing arrangement and mounted within the pump body so as to be independent from each other.

5 Claims, 2 Drawing Sheets

FIG. 2
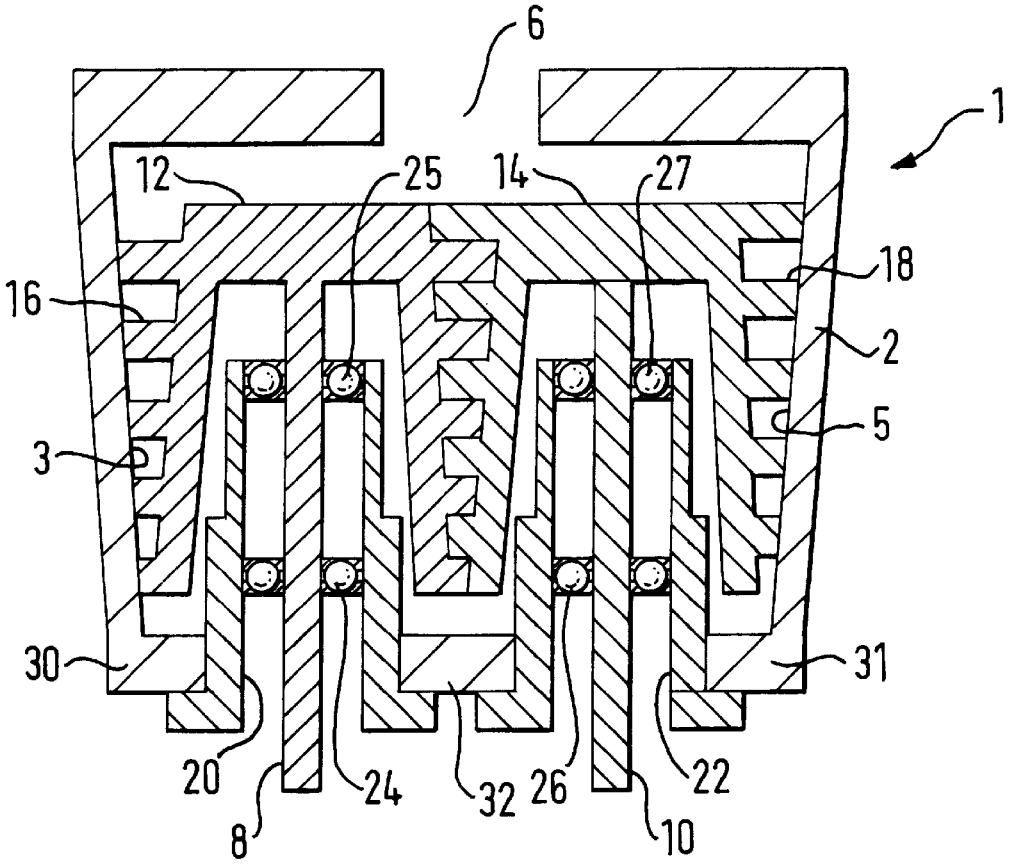
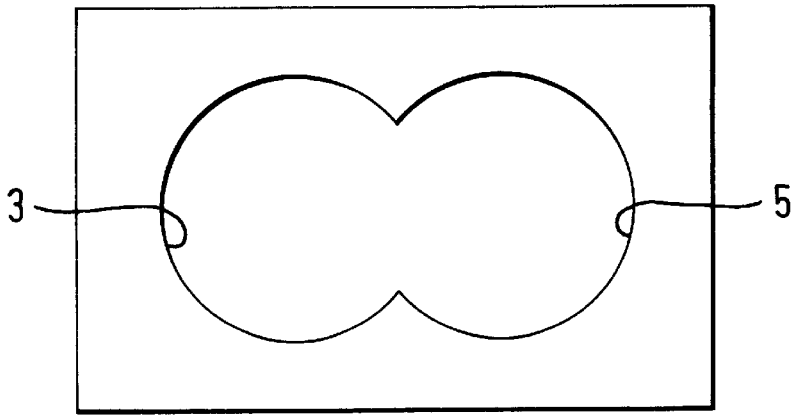
FIG. 3

SCREW PUMPS

BACKGROUND OF THE INVENTION

The present invention relates to vacuum pumps and more particularly to screw pumps.

Screw pumps usually comprise two spaced parallel shafts each carrying externally threaded rotors, said shafts being mounted in a pump body such that the threads of the rotors intermesh. Close tolerances between the rotor threads at the points of intermeshing and with the internal surface of the pump body, which acts as a stator, causes volumes of gas being pumped between an inlet and an outlet to be trapped between the threads of the rotors and said internal surface and thereby urged through the pump as the rotors rotate.

Such screw pumps are potentially attractive since they can be manufactured with few working components and they have an ability to pump from a high vacuum environment at the inlet down to atmospheric pressure at the outlet.

Conventional screw pumps with shafts which are either mounted cantilever fashion within the pump body or supported at each end with bearings use a common head plate or plates to support the bearing or bearings of both shafts. The head plate or plates are then fixed to the pump body.

This construction has several disadvantages, for example, the head plate(s) has to be or is usually cooled to keep the bearing within its operating temperatures. However, the pump body (stator) is often run much hotter particularly on screw pumps used in semiconductor manufacturing processes. This gives rise to differential thermal expansion such that the stator bores move apart but the head plate and bearings and therefore the rotors do not move as far and become off-centered relative to their respective bores. This requires the screw pump to be made with large running clearances to prevent or minimize the possibility of seizure.

Further, accurate centering of the shafts and rotors within the bores is also difficult due to the tolerance stack-up of the bearing centers and the positioning of the head plate relative to the stator which is typically effected with doweling.

It is an aim of the present invention to provide a screw pump which prevents or mitigates against the problems associated with conventional screw pumps and in particular the problem of thermal distortion.

SUMMARY OF THE INVENTION

According to the present invention a screw pump comprises a first shaft and spaced therefrom and parallel thereto a second shaft mounted in a pump body, both shafts adapted for axial counter-rotation relative to each other, a first rotor mounted on the first shaft and a second rotor mounted on the second shaft, each rotor being formed on an outside surface with at least one helical vane or thread, the helical vanes or threads intermeshing together so that rotary movement of the shafts will cause a fluid to be pumped from an inlet towards an outlet of the pump, and in that a first bearing arrangement is associated with the first shaft and a second bearing arrangement is associated with the second shaft, a bearing carrier being provided for each bearing arrangement, the bearing carriers each being mounted to the pump body independently one from the other.

In a preferred embodiment the rotors are hollow and a bearing carrier extends within each hollow rotor.

The bearing carriers should be mounted in the pump body in a manner such that centering of the bearings, and hence the shafts held in the bearings, is achieved despite thermal expansion of the pump body due to changes in working temperature of the pump body. This can be achieved in particular by attaching at least one end/edge of each bearing carrier to that part of the pump body which acts as the pump stator, normally that part which is parallel (or substantially parallel) to the pump/shaft main axes.

Each rotor may be substantially cylindrical or alternatively may be tapered in a direction from the inlet of the screw pump towards the outlet.

BRIEF DESCRIPTION OF THE DRAWINGS

For a better understanding of the invention, reference will now be made, by way of exemplification only, to the accompanying drawings in which:

FIG. 2 is a cross-section through an alternative screw pump of the invention having tapered screw rotors; and FIG. 3 is a diagrammatic section, not to scale, through the pump body of the pumps illustrated in FIGS. 1 and 2.

DETAILED DESCRIPTION

Figure 1:
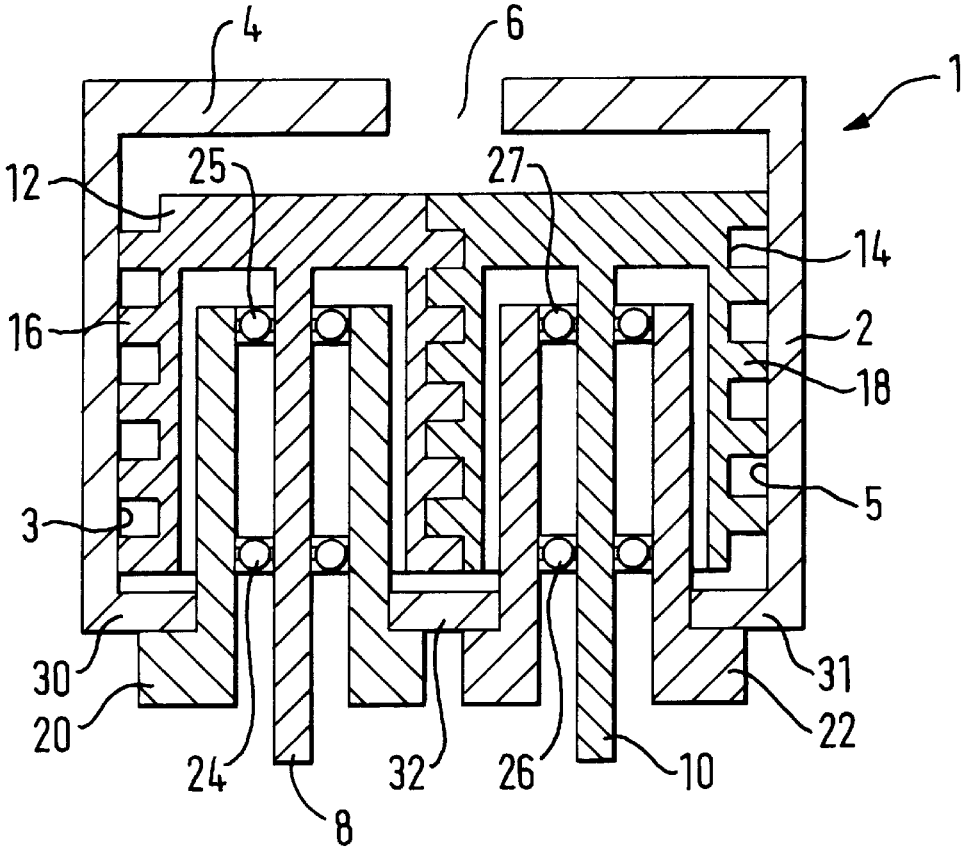
FIG. 1 is a cross-section through a screw pump according to the invention.

With reference to FIG. 1, a vacuum screw pump 1 includes a pump body 2 having a top plate 4 in which is formed an inlet 6. The pump body 2, for a major portion of its length, effectively comprises two overlapping bores 3, 5 which define between them an internal "figure-of-eight" shaped cavity (see FIG. 3) within the body 2.

Located within the pump body 2 that, is within the bore 3, is a first shaft 8 and spaced therefrom and parallel thereto a second shaft 10 in the second bore 5. Mounted for rotary movement with the first shaft 8 within the pump body 2 is a first rotor 12 and mounted for rotary movement with the second shaft 10 within the pump body 6 is a second rotor 14. The two rotors 12, 14 are generally cylindrical in shape and on the outer surface of each rotor there is formed a continuous helical vane or thread 16, 18 which vanes or threads intermesh at the pump center as illustrated.

The rotors 12, 14 are both hollow and accommodated within each hollow rotor are bearing carriers 20, 22. The bearing carriers are each attached and sealed to the pump body 2 by bolt means (not shown) independently one from the other. As shown in FIG. 1, this is achieved by reducing the diameter of the bores 3 and 5 at the locations 30, 31 respectively so that they become independent and non-overlapping to create a complete flange 32 to which the bearing carriers 20, 22 can be sealed.

As shown each bearing carrier 20, 22 contains a bearing arrangement comprising two spaced bearings, 24, 25 and 26, 27 for supporting the respective shafts 8, 10.

The shafts 8, 10 are adapted for rotation within the pump body 2 about their longitudinal axes in contra-rotational direction by virtue of the shaft 8 being connected to a drive motor (not shown) and by the shaft 10 being coupled to the shaft 8 by means of timing gears in a manner known per se.

In use, both shafts 8, 10 rotate at the same speed but in opposite directions. The fluid to be pumped will be drawn through the inlet 6 in the top plate 4 and will be pumped by means of the rotating rotors towards an outlet (not shown) in a manner known per se. The overall shape of the rotors 12, 14 and in particular the vanes or threads 16, 18 relative to each other and also relative to the inside surface of the pump body 2 are calculated to ensure close tolerances with the fluid being pumped from the inlet 6 towards the outlet as hereinbefore described.

In the above described embodiment it will be observed that the bearing carriers 20, 22 are fixed directly to the pump body 2 thereby removing the need for a conventional head plate. As the pump body 2 heats up, both the bores 3 and 5 and the bearing carriers 20, 22 move apart but keeping the rotors 12, 14 centered. It will be evident that the shafts 8, 10 must be rigidly supported and mounting the bearings carriers 20, 22 directly to the pump body 2 increases the rigidity of the general arrangement.

To enable the two independent bearing carriers 20, 22 to be sealed to the pump body 2 it is expedient for the two bores 3 and 4, which overlap each other for a major portion of the length of the pump body 2 (see FIG. 3) to be reduced in diameter where to rotors 12, 14 are mounted and to become independent bores for the last few millimeters to create a complete flange 32 for the bearing carriers 20, 22 to seal to as shown. This flange or web links the two sides of the pump body 2 further increasing its stiffness and also increasing the area available to fasten and seal the bearing carriers.

In an alternative embodiment, the rotors 12, 14 may have a tapered screw form with the taper reducing from the end adjacent the inlet 6 towards the outlet. FIG. 2 shows such an embodiment and uses generally the same reference numbers as those used in FIG. 1.

With reference to FIG. 2, the overall shape of each rotor 12, 14 is frusto-conical and tapers from the pump inlet 6 to the pump outlet (not shown). In this respect, it should be noted that it is the thread 16, 18 diameter of each rotor which decreases gradually in the direction of the pump inlet 6 to the pump outlet whereas the root diameter (rotor minus thread) will gradually increase in the same direction.

The carriers 20, 22 for the bearings 24, 25 and 26, 27 are of different design to those of the embodiment of FIG. 1; however, they again are mounted on the body 2 on the flange 32 independently of each other and again allowing in particular, in use of the pump for a centering of the shafts 8, 10 and the rotors 1 2, 14.

We claim:

1. A screw pump comprising:

a pump body;

a first shaft;

a second shaft spaced from said first shaft and parallel thereto, said second shaft mounted in said pump body;

a first rotor mounted on said first shaft;

a second rotor mounted on said second shaft each of said first and second rotors having formed on an outer surface thereof at least one helical vane or thread, the helical vanes or threads intermeshing together so that rotary movement of the first and second shafts will cause a fluid to be pumped;

a first bearing arrangement associated with the first shaft;

a second bearing arrangement associated with the second shaft, and bearing carriers for each of the first and second bearing arrangement, the bearing carriers each mounted to the pump body independently of each other.

2. The screw pump according to claim 1, in which the first and second rotors are hollow and said bearing carriers extend within said first and second rotors.

3. The screw pump according to claim 1 in which each of the bearing carriers accommodates a bearing arrangement comprising two spaced bearings.

4. The screw pump according to claim 1 in which each of the first and second rotor is substantially cylindrical.

5. The screw pump according to claim 1 in which each rotor is tapered.

* * * * *